United States Patent [19]

Pitts

[11] 4,407,856

[45] Oct. 4, 1983

[54] ANAEROBIC PROCESS FOR CURING RADIATION CURABLE COMPOSITIONS

[75] Inventor: Warren R. Pitts, Needham, Mass.

[73] Assignee: Dennison Manufacturing Company, Framingham, Mass.

[21] Appl. No.: 349,417

[22] Filed: Feb. 16, 1982

Related U.S. Application Data

[63] Continuation of Ser. No. 140,333, Apr. 14, 1980, abandoned.

[51] Int. Cl.[3] ..... B05D 3/06

[52] U.S. Cl. ..... 427/54.1; 156/327; 204/159.15; 427/44

[58] Field of Search ..... 427/44, 54.1; 156/327; 204/159.15

[56] References Cited

U.S. PATENT DOCUMENTS

| | | | |
|---|---|---|---|
| 3,595,969 | 7/1971 | Shepherd et al. | 156/327 |
| 3,725,116 | 4/1973 | Parker et al. | 427/54.1 |
| 3,795,641 | 3/1974 | Lees et al. | 525/305 |
| 3,989,609 | 11/1976 | Brack | 427/44 |
| 4,004,998 | 1/1977 | Rosen | 427/54.1 |
| 4,180,599 | 12/1979 | Wolpert et al. | 427/54.1 |

*Primary Examiner*—John H. Newsome

*Attorney, Agent, or Firm*—George E. Kersey; Arthur B. Moore; Barry D. Josephs

[57] ABSTRACT

A novel process is described for curing radiation-curable liquid compositions. The compositions are cured by exclusion of oxygen, alone or in combination with exposure to radiation. The compositions preferably include known photoinitiators but are substantially free of known anaerobic initiators.

9 Claims, No Drawings

ANAEROBIC PROCESS FOR CURING RADIATION CURABLE COMPOSITIONS

This is a continuation, of Ser. No. 140,333, filed Apr. 14, 1980, now abandoned.

BACKGROUND OF THE INVENTION

This invention relates to anaerobically curable coatings and adhesives, and more particularly to a process for anaerobic curing which uses compositions substantially free of known anaerobic initiators.

Anaerobic adhesives are liquid compositions stable in the presence of oxygen but curing or polymerizing upon exclusion of oxygen, generally by disposition between two substantially impervious surfaces. Such compositions are well known and are in substantial commercial use to lock or seal mechanical assemblies and as structural adhesives. They are described in numerous references, including for example, Sheist, "Handbook of Adhesives", pages 560–568, and U.S. Pat. Nos. 2,628,178; 2,895,950; 4,118,442; 4,103,081; 4,070,334; 4,056,670; 4,054,480; 4,044,044; 3,988,299; 3,933,748; 3,625,930; 3,435,012; 3,425,988; 3,300,547; 3,218,305; 3,203,941; and 3,046,262.

A wide variety of monomers and prepolymers useful in anaerobic polymerizing adhesives are known. Generally, they are acrylate monomers and terminally acrylated prepolymers. Anaerobic curing is initialed by catalysts which are diazonium compounds (see U.S. Pat. No. 4,070,334), sulfones (see U.S. Pat. No. 4,054,480) or peroxides, particularly organic peroxides, and most commonly hydroperoxides such as cumeme hydroperoxide. A variety of accelerators and inhibitors useful with such catalysts are also known. In the Sheist article cited above, at page 567, it is disclosed that some of the newer anaerobic adhesives may also be cured with exposure to ultraviolet light, a procedure described as useful in the bonding and sealing of glass.

Radiation curable coatings based on acrylates and acrylated prepolymers are also known and described, for example, in U.S. Pat. No. 3,989,609 and in references therein cited. For curing by exposure to ultraviolet radiation, photoinitiators or catalysts are used which are different from those used for anaerobic curing, for example, benzoin ethers. Such photoinitiators are described, for example, at lines 44–55, column 3, of U.S. Pat. No. 3,989,609. While it is known that oxygen can inhibit photopolymerization, anaerobic curing of such systems does not appear to have been previously recognized or described.

SUMMARY OF THE INVENTION

According to the present invention, it has now been found that radiation curable acrylates and acrylated prepolymer compositions can be anaerobically cured without use of any of the anaerobic catalysts and catalyst systems heretofore employed. The preferred compositions are those described in U.S. Pat. No. 3,989,609 which is incorporated herein by reference. Radiation curable mixtures of acrylate monomers and acrylated epoxy resins are also preferred. Most preferred are mixtures of acrylate monomers and arcylated prepolymers which are the stepwise reaction product of polyether triol, a polyisocyanate, and a hydroxy lower ester of acrylic or methacrylic acid. Such products are described in Examples 1–11 of U.S. Pat. No. 3,989,609. Inclusion of photoinitiator is also preferred, based on its use to date, but may be omitted in applications of compositions anaerobically curing without it. Other additives such as viscosity modifiers, tackifiers or accelerators may be added, if desired.

The compositions of this invention may be cured either with or without the use of curing exposure to radiation. By curing exposure is meant an intensity of radiation greater than ambient which is sufficient to cure and solidify at least the surface of the composition. For many bonding and sealing applications of this invention, curing UV exposure is unnecessary and is omitted. However, anaerobic curing may be usefully combined with UV curing radiation to shorten cure times or to complete cure of relatively thick or opaque coatings.

DESCRIPTION OF PREFERRED EMBODIMENT

The following examples illustrate the anaerobic curing of commercially available ultraviolet (UV) curing compositions.

In Examples 1–4 below, the UV curable composition employed was VOROCRYL 3S, a composition substantially as described in Example 10 of U.S. Pat. No. 3,989,609 and sold by the Dennison Manufacturing Company, Framingham, MA or the Design Cote Company, Natick, MA. It should be noted that the composition employed contained benzoin isobutyl ether as photoinitiator, and a small amount of p-methoxy phenol as polymerization inhibitor, but contained no diazonium compound, sulfone, or organic peroxide.

EXAMPLE 1

In the course of coating with a UV composition on a printing press equiped with U.V. lamps as desired in Example 10 of U.S. Pat. No. 3,989,609, some of the coating liquid overflowed between one of the press shafts and a gear hub mounted thereon. The composition solidified, in the absence of lamp exposure, and the gear was bonded to the shaft.

EXAMPLE 2

A 10–32 socket head cap screw with a black oxide finish was dipped in clear VOROCRYL 3S, a 10–32 nickel plated nut screwed thereon, and the combination left indoors overnight. The nut was bonded to the screw.

EXAMPLE 3

Example 2 was repeated and the nut could not be easily removed after one hour. Thereafter, a force of about 84 pounds was required to turn the nut initially, the force decreasing and remaining substantially constant for five turns at 63 pounds.

EXAMPLE 4

VOROCRYL 3S was applied between various materials, including metal screws and nuts, glass slides, and metal washers. The combinations were cured in a vacuum oven at room temperature, without exposure to curing radiation. They were bonded together.

EXAMPLES 5–7

Examples 2–4 were repeated, substituting for VOROCRYL 3S, UV clear coating composition No. 817-C-306 (RB-7608) of Conchemco, Inc., Kansas City, MO 64127. This composition is understood to contain acrylated epoxy resin, acrylic and vinyl monomers, and an aryl ketone as photoinitiator; and to be substantially free of known anaerobic initiators. Similar results were obtained. This composition was also found to lock a steel collar to a 9/16 inch steel shaft.

In one instance of testing the vacuum oven, one screw and nut combination was incompletely cured when removed from the oven after one hour, but fully cured within one more hour outside the oven in indoor ambient lighting. In one additional instance, curing on a glass slide was incomplete, and the inclusion of metal accelerators as known in the anaerobic art may be advisable. In all other instances, the compositions cured on glass in the vacuum oven without accelerator.

The materials used in the foregoing examples were stored for months in a glass jar sealed with a metal cover, exposed to normal ambient indoor lighting, without polymerizing.

Based on the foregoing experiments, it is believed that a wide variety of acrylate U.V. curable compositions may be cured anaerobically without the usual curing systems heretofore employed. It is also believed that improved curing of UV coatings may be obtained by combining UV and anaerobic curing, for example by exposing the coating to radiation in a vacuum, or by radiation exposure followed by confinement between impervious surfaces. For example, after UV exposure, the coating may be covered by a substantially air impervious release sheet, cured, and, if desired, thereafter stripped. Such procedure, for example, may permit faster coating speeds and/or better curing of thick or pigmented coatings.

It should be understood that the foregoing description is for the purpose of illustration and that the invention includes all equivalents and modifications within the scope of the appended claims.

What is claimed is:

1. A process for anaerobic curing of a composition which comprises the steps of (a) applying to a surface an unoxygenated radiation curable composition consisting of a monomer and a tri-functional oligomer;

(b) excluding oxygen from said composition on said surface and (c) allowing said composition to solidify.

2. A process according to claim 1 wherein oxygen is excluded from said composition by applying thereto a substantially air impervious surface.

3. A process for anaerobic curing of a composition which comprises the steps of (a) applying to a surface a radiation curable composition consisting of a monomer, a tri-functional oligomer and a photoinitiator;

(b) exluding oxygen from said composition on said surface; and (c) allowing said composition to solidify.

4. A process according to claim 3 wherein said composition comprises a mixture of acrylate monomers and a prepolymer which is the stepwise reaction product of (a) substantially three mols of a polyisocyanate with (b) substantially one mol of a polyether triol and (c) hydroxy lower esters of acrylic or methacrylic acid.

5. A process according to claim 4 wherein said prepolymer is the reaction product of substantially three mols of said hydroxy lower esters of acrylic or methacrylic acid, and said polyisocyanate is toluene diisocyanate.

6. A process according to claim 5 wherein said photoinitiator is a benzoin alkyl ether.

7. A process according to claim 3 for curing a coating on a surface comprising the further step of exposing the coating to a UV radiation.

8. A process according to claim 3 wherein oxygen is excluded from said composition by applying thereto a substantially air impervious surface.

9. A process according to any one of claims 1–6 and 8, wherein said composition is cured anaerobically in the absence of exposure to curing UV radiation.

* * * * *